US010450811B2

(12) United States Patent
Roodenburg et al.

(10) Patent No.: US 10,450,811 B2
(45) **Date of Patent: *Oct. 22, 2019**

(54) OFFSHORE DRILLING VESSEL AND METHOD

(71) Applicant: ITREC B.V., Schiedam (NL)

(72) Inventors: Joop Roodenburg, Delft (NL); Diederick Bernardus Wijning, Schiedam (NL)

(73) Assignee: ITREC B.V., Schiedam (NL)

( * ) Notice: Subject to any disclaimer, the term of this patent is extended or adjusted under 35 U.S.C. 154(b) by 0 days.

This patent is subject to a terminal disclaimer.

(21) Appl. No.: 16/041,601

(22) Filed: Jul. 20, 2018

(65) Prior Publication Data

US 2018/0328122 A1 Nov. 15, 2018

Related U.S. Application Data

(63) Continuation of application No. 15/123,522, filed as application No. PCT/NL2015/050131 on Mar. 3, 2015, now Pat. No. 10,053,928.

(30) Foreign Application Priority Data

Mar. 3, 2014 (NL) ..... 2012355

(51) Int. Cl.
*E21B 15/02* (2006.01)
*E21B 19/00* (2006.01)
(Continued)

(52) U.S. Cl.
CPC ..... *E21B 19/002* (2013.01); *B63B 35/4413* (2013.01); *E21B 15/02* (2013.01);
(Continued)

(58) Field of Classification Search
CPC ..... E21B 15/02; E21B 19/002; E21B 19/07; E21B 19/10; E21B 19/143; E21B 19/146; E21B 19/16; B63B 35/4413
See application file for complete search history.

(56) References Cited

U.S. PATENT DOCUMENTS 4,049,239 A 9/1977 Howell
6,000,480 A * 12/1999 Eik ..... E21B 19/008 166/350
(Continued)

FOREIGN PATENT DOCUMENTS

CN 102606087 A 7/2012
WO WO 00/11305 A1 3/2000
(Continued)

OTHER PUBLICATIONS

European Office Communication pursuant to Article 94(3) EPC for European Application No. 15710953.9, dated Apr. 5, 2018.

*Primary Examiner* — Matthew R Buck
(74) *Attorney, Agent, or Firm* — Birch, Stewart, Kolasch & Birch, LLP

(57) ABSTRACT

An offshore drilling vessel includes a floating hull subjected to heave motion. The hull includes a moonpool and a drilling tower near the moonpool. A drilling tubulars storage rack is provided for storage of drilling tubulars. The vessel includes a heave motion compensation support that is adapted to support a slip device whilst performing heave compensation motion relative to the heaving motion of the vessel. A racking device is provided with a heave motion synchronization system that is adapted to bring a tubular retrieved from the storage rack in heave motion into a vertical motion that is synchronous with the heave compensation motion of the string slip device. The racking device includes vertical rails and at least two separate motion arm assemblies mounted on said vertical rails. Each separate motion arm assembly includes its own vertical drive which is electrically connected to the heave motion synchronization system.

17 Claims, 16 Drawing Sheets

(51) Int. Cl.

| | |
|---|---|
| ***B63B 35/44*** | (2006.01) |
| ***E21B 19/14*** | (2006.01) |
| ***E21B 19/07*** | (2006.01) |
| ***E21B 19/10*** | (2006.01) |
| ***E21B 19/16*** | (2006.01) |

(52) U.S. Cl.
CPC ..... *E21B 19/07* (2013.01); *E21B 19/10* (2013.01); *E21B 19/143* (2013.01); *E21B 19/146* (2013.01); *E21B 19/16* (2013.01)

(56) References Cited

U.S. PATENT DOCUMENTS

| | | | | |
|---|---|---|---|---|
| 6,068,066 | A * | 5/2000 | Byrt | E21B 15/02 173/152 |
| 6,343,662 | B2 * | 2/2002 | Byrt | E21B 15/02 173/152 |
| 6,595,494 | B1 * | 7/2003 | Roodenburg | B66C 13/02 254/277 |
| 8,425,171 | B2 * | 4/2013 | Mortensen | E21B 19/146 211/70 |
| 10,053,928 | B2 * | 8/2018 | Roodenburg | B63B 35/4413 |
| 2012/0103623 | A1 * | 5/2012 | Wijning | E21B 19/146 166/352 |
| 2012/0305261 | A1 * | 12/2012 | Roodenburg | E21B 15/02 166/352 |
| 2014/0064883 | A1 * | 3/2014 | Sondervik | E21B 19/087 414/22.51 |

FOREIGN PATENT DOCUMENTS

| | | | |
|---|---|---|---|
| WO | WO 2011/074951 | A1 | 6/2011 |
| WO | WO 2013/169099 | A2 | 11/2013 |

* cited by examiner

OFFSHORE DRILLING VESSEL AND METHOD

CROSS REFERENCE TO RELATED APPLICATIONS

This application is a Continuation of U.S. patent application Ser. No. 15/123,522 filed on Sep. 2, 2016, which was filed as the National Phase of PCT International Application No. PCT/NL2015/050131 filed on Mar. 3, 2015, which claims the benefit of priority to Dutch Application No. 2012355 filed on Mar. 3, 2014, all of which are hereby expressly incorporated by reference into the present application.

The present invention relates to an offshore drilling vessel and method of use thereof.

Many offshore drilling activities are performed from offshore drilling vessels that have a floating hull that is subjected to heave motion. In common designs, e.g. in a mono-hull design or as a semi-submersible, the hull is provided with a moonpool through which the drilling is performed. The drilling vessel has a drilling tower that is arranged on the hull at or near the moonpool. For example the tower is a mast having a base connected to the hull and arranged above or adjacent the moonpool. In another known design the tower is a derrick, e.g. with a latticed derrick frame, the derrick being placed over the moonpool.

Commonly one or more drilling tubulars storage racks are provided, e.g. each embodied as a vertical axis carousel. The storage rack is adapted for storage of drilling tubulars, e.g. drill pipe stands, casing stands, etc., in vertical orientation therein.

The storage rack or racks are commonly mounted on the hull so as to be subjected to heave motion along with the hull.

To perform a drill task the vessel is commonly provided with a tubulars string slip device, which slip device is adapted to support the weight of a tubulars string, e.g. a drill string, suspended therefrom along a firing line. In the art a riser is commonly arranged between the wellbore and the vessel and the tubular string extends into the riser and into the subsea formation.

The vessels are commonly equipped with a pipe racker system that is adapted to move a tubular between the storage rack and a position in the firing line above the tubulars string slip device in order to allow for making a connection between a new tubular and the suspended tubular string or the removal of a tubular from the tubular string during tripping.

In a first aspect according to the invention, the vessel comprises a heave motion compensation support that is adapted to support the slip device whilst performing heave compensation motion relative to the heaving hull of the vessel, e.g. a heave motion compensated working deck,
and in that the racking device is provided with a heave motion synchronization system that is adapted to bring a tubular retrieved from the storage rack into a vertical motion that is synchronous with the heave compensation motion of the tubulars string slip device, thereby allowing for the connection of the tubular to the suspended tubulars string whilst the slip device performs heave compensation motion relative to the heaving hull of the vessel.

Herewith a new tubular or the tubular to be removed can be handled by the pipe racker system whilst the slip device is in heave compensation mode relative to the hull of the vessel. For a new tubular to be attached to the suspended tubulars string this involves gripping the tubular e.g. directly from the storage rack or first conveyed to a pick-up location by another tubular advancing mechanism, and then starting to bring the gripped tubular in a vertical motion pattern so as to finally arrive at a vertical motion pattern that is sufficiently synchronized with the slip device. This synchronization then allows to bring the tubular close above the upper end of the suspended tubular string and finally to bring about the connection thereto, all of this whilst the heave compensation motion continues.

The same applies to the removal of a tubular from the suspended string, e.g. during tripping, but then in reverse order. So then one or more grippers of pipe racker system are brought in the synchronized vertical motion pattern, after which the still connected tubular is gripped and then disconnected from the suspended tubulars string. Then then disconnected tubular is moved to the side, towards the storage rack and basically brought to a stand-still in vertical direction relative to the hull for the transfer into the storage rack.

U.S. Pat. No. 6,000,480 discloses an offshore drilling vessel including a system for drilling an oil well. The system comprises a frame-like structure, also called an access module, which is stationary in relation to a floating vessel. The system further comprises a support structure. In between the stationary structure and the support structure, the system includes two compensators which are mounted for providing compensating power. The system further comprises a pipe handler. The pipe handler is provided with telescopic grippers. The pipe handler comprises a trolley which is connected to a wire which is guided over a jigger winch for lifting the pipe handler. The pipe handler is designed to operate in two modes. In a first mode, a pipe is handled without relative motion between the pipe handler and the deck of the vessel. This will allow the pipe handler to remain supported at the deck of the vessel as long as the pipe handler picks up a pipe from the deck. In a second mode, a pipe is handled without relative movement between the pipe handler and the compensated support structure, such that the pipe handler moves synchronously with the compensated support structure.

It is an object of the present invention to increase the versatility of floating drilling vessels, e.g. in view of allowing drilling techniques that save drilling time, that allow for drilling through difficult formations (e.g. in view of wellbore pressure requirements), etc. Particularly, it is an object to provide a racking device which contributes to save drilling time.

In a first aspect, the present invention provides an offshore drilling vessel according to the preamble of claim 1, which is characterised in that, the racking device comprises:

a vertical rails, at least two separate motion arm assemblies mounted on said vertical rails, wherein each motion arm assembly comprises a own base that is vertically mobile along said vertical rails by a vertical drive positioned on said base which vertical drive includes a motor, and a motion arm connected to said base, the motion arm of at least one arm assembly being provided with a tubular gripper member connected to said arm,
wherein each motor of the vertical drive of at least one motion arm assembly is electrically connected to the heave motion compensation controller of the heave motion synchronization system.

The wording separate means that the motion arm assembly can move along the vertical rails independent from another motion arm assembly. The motion arm assemblies are not positioned on a common base, but each have an own individual base which can slide along said vertical rails which is preferably a common vertical rails. The presence of separate motion arm assemblies may provide several advantages which will be explained hereafter.

Each separate motion arm assembly includes its own vertical drive which is positioned on the base of the motion arm assembly. Herewith, each motion arm assembly forms an independent unit which can be operated independent from the other motion arm assemblies. The separate motion arm assemblies may provide an operational advantage in that during operation the separate motion arm assemblies can be spaced from each other at a distance which is determined by an operator. The distance in between two motion arm assemblies is not fixed by its structure. In dependence of a tubular length to be handled, an operator may determine a gripping of the tubular at a plurality of gripping positions which are spaced at a certain distance away from each other. An operator may determine an operational amount of gripper members and may determine a distance in between two gripper members.

Advantageously, the separate motion arm assemblies provide a modular system in that the amount of mounted motion arm assemblies can be adapted to occurring circumstances or a desired length of tubulars which has to be handled. Preferably, the racking device comprises at least three separate motion arm assemblies mounted on said vertical rails to handle a tubular of at least 30 m, in particular 36 m. More preferably, the racking device comprises at least four separate motion arm assemblies preferably mounted on one common vertical rails to handle a tubular of at least 40 m, in particular 48 m. Advantageously, the racking device including separate assemblies can be easily configured for different purposes.

By providing independent assemblies, the operational reliability of the racking device is increased. A malfunction to one of the independent assemblies, does not necessarily cause a complete shutdown of the racking device. Under circumstances, an operation may still be carried out by remaining assemblies, e.g. by switching to a shorter tubular.

Advantageously, because of the presence of multiple motion arm assemblies on board of a vessel which include common components, the technical possibilities for a repair and servicing of the assemblies are increased. The multiple separate motion arm assemblies include a lot of common components which contributes to a more simple logistics of spare parts on board of a vessel and which increases the technical possibilities in case of a malfunction of one of the assemblies, e.g. a common component can be interchanged in between two assemblies. Thus, the multiple independently configured motion arm assemblies contribute to an operational flexibility and a more reliable drilling operation in which drilling time can be saved.

The inventive drilling vessel e.g. allows for a drilling operation to be performed wherein the slip device is maintained above a fixed length riser between the vessel and the seabed, e.g. with a slip joint in said riser being in collapsed and locked position to allow for an increased pressure rating of the slip joint compared to the pressure rating thereof when in dynamic stroking mode. For example a rotating control device, named RCD in the field, is employed to obtain a seal of the annulus between the riser and the tubular string, e.g. allowing to precisely control the pressure of return fluid through the annulus. The latter is for example used in techniques as Managed Pressure Drilling.

In a second aspect according to the invention, the invention relates to an offshore drilling vessel, the vessel comprising:

- a floating hull subjected to heave motion, the hull being provided with a moonpool,
- a drilling tower at or near the moonpool,
- a drilling tubulars storage rack, e.g. a carousel, adapted for storage of drilling tubulars, e.g. drill pipe stands, in vertical orientation therein, the storage rack being mounted on the hull so as to be subjected to heave motion along with the hull,
- a tubulars string slip device, which slip device is adapted to support the weight of a tubulars string, e.g. a drill string, suspended therefrom along a firing line,
- a racking device comprising:
- a pipe racker system that is adapted to move a tubular between the storage rack and a position in the firing line above the tubulars string slip device in order to allow for making a connection between a new tubular and the suspended tubular string or the removal of a tubular from the tubular string during tripping.

In the second aspect of the invention, the racking device comprises a motion system including a controller that is adapted to bring a tubular retrieved from the storage rack into a vertical motion towards the tubulars string slip device, thereby allowing for the connection of the tubular to the suspended tubulars string. The vessel further comprises a support that is adapted to support said slip device, e.g. a working deck.

According to the second aspect of the invention the racking device comprises:

- a vertical rails,
- at least two separate motion arm assemblies mounted on said vertical rails, wherein each motion arm assembly comprises:

- an own base that is vertically mobile along said vertical rails by a vertical drive including a motor which vertical drive is positioned on said base, and
- a motion arm connected to said base, the motion arm of at least one arm assembly being provided with a tubular gripper member connected to said arm, wherein each motor of the vertical drive of at least one motion arm assembly is electrically connected to the controller of the motion system.

So, according to the second aspect according to the invention, the synchronization system is an example of a motion system. According to the second aspect, a motion of a motion arm assembly can be an any desired motion. The embodiments presented hereafter can be configured according to the first aspect which includes a synchronization system and according to the second aspect of the invention which is arranged without such synchronization system.

In an embodiment of the vessel according to the invention, each vertical drive of each motion arm assembly comprises a hydraulic power unit which is dedicated to each motion arm assembly. The hydraulic power unit includes a pump which is driven by an electric motor, a tank which forms a reservoir for hydraulic liquid, and valves to control the unit. In comparison with a centrally provided hydraulic power unit for controlling several motion arm assemblies, a dedicated hydraulic power unit provides an advantage in a reduction of hydraulic conduits. Extending hydraulic conduits may be vulnerable to get damaged which might result to oil leakages on board of the vessel. Due to the individual hydraulic power units, hydraulic conduits which extend over a long distance from a central pump to a particular motion arm assembly are no longer necessary. By providing each motion arm assembly with its own hydraulic power unit which is positioned on the base of the motion arm assembly, a risk on oil leakages is greatly reduced which provides an environmental advantage.

In an embodiment of the vessel according to invention, the hydraulic power unit is connected to the controller by at least one umbilical cable, which is an electrical cable. The umbilical cable extends in between the controller and the motion arm assembly. One end of the umbilical cable is connected to the controller at a fixed position on the floating hull and the other end is connected to the hydraulic power unit on board of the motion arm assembly.

In an embodiment of the vessel according to the invention, the umbilical cable is looped around a cable length compensating device to compensate a varying length of the umbilical cable in between the controller and the hydraulic power unit caused by a motion of an motion arm assembly. According to the first aspect, the motion of the motion arm assembly can be a synchronous motion. According to the second aspect, the motion of the motion arm assembly can be an arbitrary motion.

In an embodiment of the vessel according to the invention, the cable length compensating device is positioned inside a mast inner space. Advantageously, the umbilical cable is situated in a protected region which makes the umbilical cable less vulnerable to get damaged.

Preferably, an intermediate portion of the umbilical cable is looped around an umbilical pulley which is a movable pulley to compensate for a varying umbilical cable length in between the controller and the hydraulic power unit during a movement of the motion arm assembly.

In an embodiment of the vessel according to the invention, the umbilical movable pulley is provided with a counterweight to maintain a tension in the umbilical cable during a movement of the motion arm assembly.

In an embodiment of the vessel according to the invention, the electric motor is connected with a supercapacitor which super capacitor allows a temporary storage of electricity. The electricity may be generated by said electric motor during a downward motion of the motion arm assembly.

In an embodiment of the vessel according to the invention, the electric motor of the hydraulic power unit is positioned at a distance away from that gripping member, such that the motor is maintained outside an Ex-zone during operation. An Ex-zone is an environment with an explosive atmosphere. The Ex-zone may be defined by a directive dedicated to a certain country. In dependence of a selected country for operation of the vessel, the positioning of the electric motor may be such to comply to that particular directive. For European countries, the Ex-zone may be defined by an ATEX directive (ATmosphères EXplosibles), in particular ATEX workplace directive number 137. For the USA, the Ex-zone may be defined by API RP 505 titled 'Recommended practice for classification of locations for electrical installations at petroleum facilities classified as class 1, zone 0, zone 1 and zone 2. Advantageously, the positioning of the electric motor outside the Ex-zone allows a more simple configuration of the electric motor without otherwise necessary high safety requirements for operation.

In an embodiment of the vessel according to invention, the drilling tower comprises a mast, wherein a side of the mast facing the moon pool, in particular the working deck, is provided with two racking devices each comprising at least two motion arm assemblies in a substantially mirrored symmetry. A first racking device comprises at least two motion arm assemblies in a left-hand attachment version. The second racking device comprises at least two motion arm assemblies in a right-hand attachment version. The left-hand attachment version is substantially a mirrored version in a vertical plane of the right-hand attachment version. The availability of the mirrored version of the motion arm assembly provides an advantage and increase of common components of the motion arm assemblies which contributes to a simplified logistics in repair and maintenance services on board of the vessel.

In an embodiment of the vessel according to the invention, the left-hand and right-hand attachment version of the motion arm assembly include a common base. The base allows an attachment of a motion arm at respectively a left or right side of the base. The base has for example a flange provided with through holes for mechanically connecting the motion arm.

In an embodiment of the vessel according to the invention, the vertical rails comprises a vertical toothed rack. Each mobile base of the at least two motion arm assemblies comprises one or more motor driven pinions which engage to said toothed rack. In comparison with a wire suspension of the at least two motion arm assemblies, the provision of the rack/pinion engagement contributes to a rigid positioning of the motion arm assemblies in both an upwards and downwards direction. Further, the rack/pinion engagement instead of a wire suspension requires less working space. Due to the rack/pinion engagement, no guidance of upwards extending suspension wires is necessary.

In an embodiment the vertical rails comprises a vertical guide rails onto which corresponding guide members, e.g. rollers, of the base of each motion arm assembly engage, and wherein the rails further comprises said vertical toothed rack arranged parallel to said vertical guide rails, wherein the base of the motion arm assembly is provided with one or more pinions engaging said vertical toothed rack, the base being provided with one or more motors driving said one or more pinions, preferably one or more electric motors.

Preferably, the toothed rack is mounted onto the vertical rail. In particular, the toothed rack is mounted at a middle region of the vertical rails, wherein the vertical rails comprises a guide rails member at two opposite side edges.

If the toothed rack is fixedly mounted to the hull, e.g. to the mast as is a preferred embodiment, the motion arm assembly motor will be operational to perform the entirety of the heave compensation motion when the arm can only pivot about a vertical axis relative to the base of the assembly. If the arm would also be able to pivot about a horizontal axis relative to the base, with an actuator being provided to cause said pivoting in up and down motion, then at least some of the motion required to obtain the synchronized heave motion can be derived from said pivoting actuator.

In another solution the toothed rack is vertically mobile so as to perform a heave compensating motion or at least a part thereof. For example the rack is slidable vertically relative to the mast. The vertically mobile toothed rack could be connected to a dedicated vertical drive of the toothed rack. In the alternative the toothed rack could be connected to another component of the drilling vessel that is or can be brought in heave compensation motion, e.g. to a heave compensated working deck or to a block of heave compensated drawworks.

In an embodiment the vessel comprises a heave motion compensated working deck that forms the heave motion compensation support adapted to support the slip device. The heave compensation motion can be provided by a dedicated system for the working deck or by connecting the working deck to another component of the vessel that is heave compensated, e.g. a heave compensated travelling block or an inline heave compensator device between the travelling block and the drill string.

The working deck can e.g. be guided along one or more vertical rails mounted to a face of a drilling mast.

For example an iron roughneck device is arranged on the heave motion compensated working deck to assist in making and breaking screw threaded connections between the new tubular or the tubular to be removed on the one hand and the suspended tubular string on the other hand.

In an alternative embodiment the iron roughneck device is not mounted on the heave motion compensated support, e.g. working deck, but is independently supported on the hull of the vessel by an iron roughneck support device. For example the iron roughneck device is supported by a motion arm assembly movable along a vertical rails as described herein.

In an embodiment the vessel comprises a roughneck system that is not integrated with the pipe racker system, and which comprises a vertical roughneck rails, and a motion arm assembly mounted on said vertical rails, wherein the motion arm assembly comprises a base that is vertically mobile along said vertical rails by a vertical drive including a motor, and a motion arm connected to said base, the motion arm of at least one arm assembly being provided with a roughneck, wherein the motor of the vertical drive is connected to a heave motion compensation controller of the heave motion synchronization system.

In an embodiment the motion arm is a telescopic extensible arm, the arm having a first arm segment which is connected to the base via a vertical axis bearing allowing the motion arm to revolve about said vertical axis. In a structurally simple embodiment the vertical axis forms the only axis of revolution of the arm. The arm further comprises one or more telescoping additional arm segments, e.g. with interposition of a hydraulic cylinder to cause the extension and retraction of the arm.

In an embodiment the slip device or working deck supporting the slip device is suspended from a heave compensated component of the vessel e.g. a heave compensated travelling block as disclosed in WO2013/169099. One can also envisage that the slip device or working deck supporting the slip device is suspended directly from a heave compensated crown block. Such a suspension can e.g. be done with multiple suspension members, e.g. rods, cables, chains, or even with the mentioned toothed rack as suspension member.

In an embodiment the vessel comprises a well center tools storage structure that is adapted to store therein the one or more well center tools that are connectable to the motion arm of the lowermost motion arm assembly.

In an embodiment of the vessel according to the invention, the storage rack is a rotary storage rack, also called a storage carousel, which is in particular rotatable mounted on the vessel, in particular rotatable about a vertical axis. Preferably, the rotary storage rack is mounted to the drilling tower. More in particular, the drilling tower is provided with a pair of rotary storage racks which are positioned at a starboard and portside of the drilling tower.

The present invention also relates to a method according to the first or second aspect, wherein use is made of a drilling vessel according to the invention.

In the drawings:

FIG. 1 shows an example of an offshore drilling vessel according to the invention in vertical cross-sectional view, FIG. 2 shows a more detailed view of the drilling side of the mast, FIG. 3 shows the drilling side of the mast as well as parts of the hull, FIG. 4 shows the drilling side of the mast and storage carousels with the working deck in heave compensation motion, FIG. 5 shows a detail of the situation of FIG. 4, FIG. 6 illustrates an upper portion of the riser in FIGS. 4 and 5, including a slip joint in locked and collapsed position, FIG. 7A shows in a perspective view a base of the motion arm assembly;

Figure 9A:
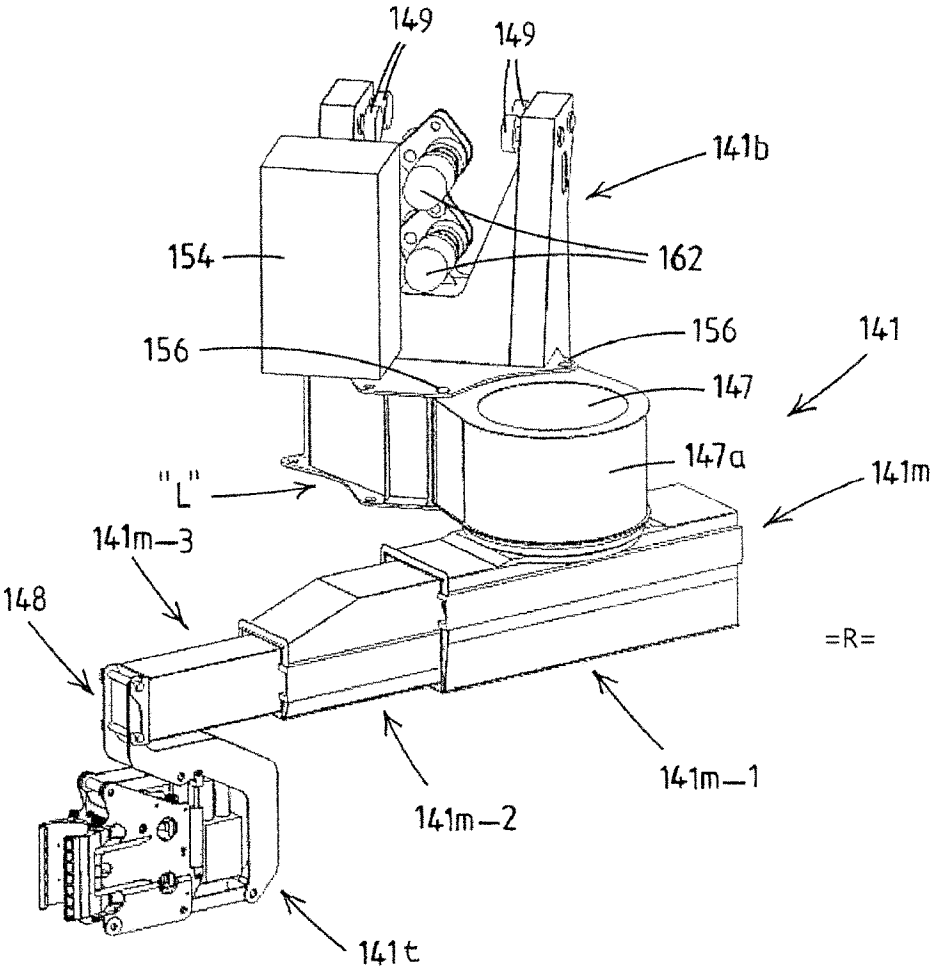
FIG. 9A shows in a perspective view a racker assembly of the system of FIG. 2.
Figure 9B:
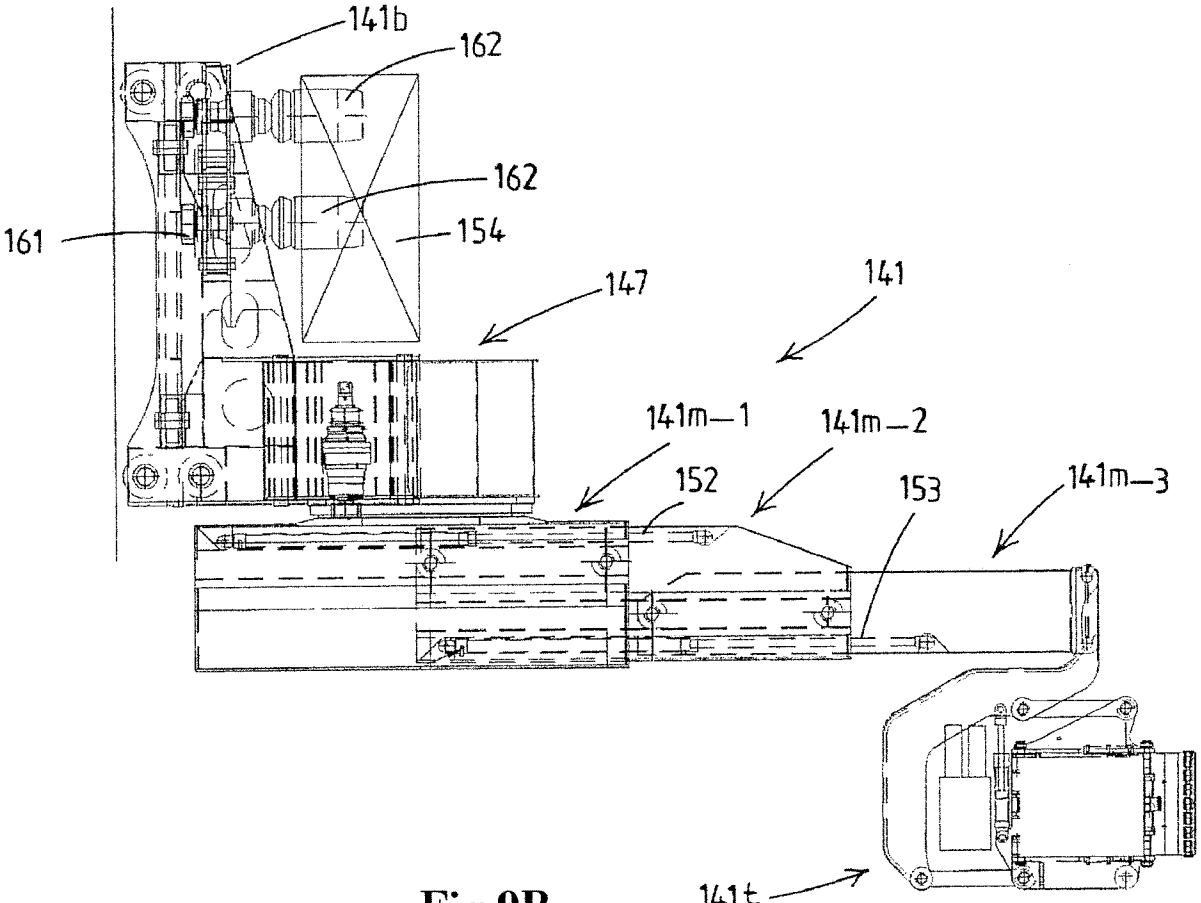
Figure 9C:
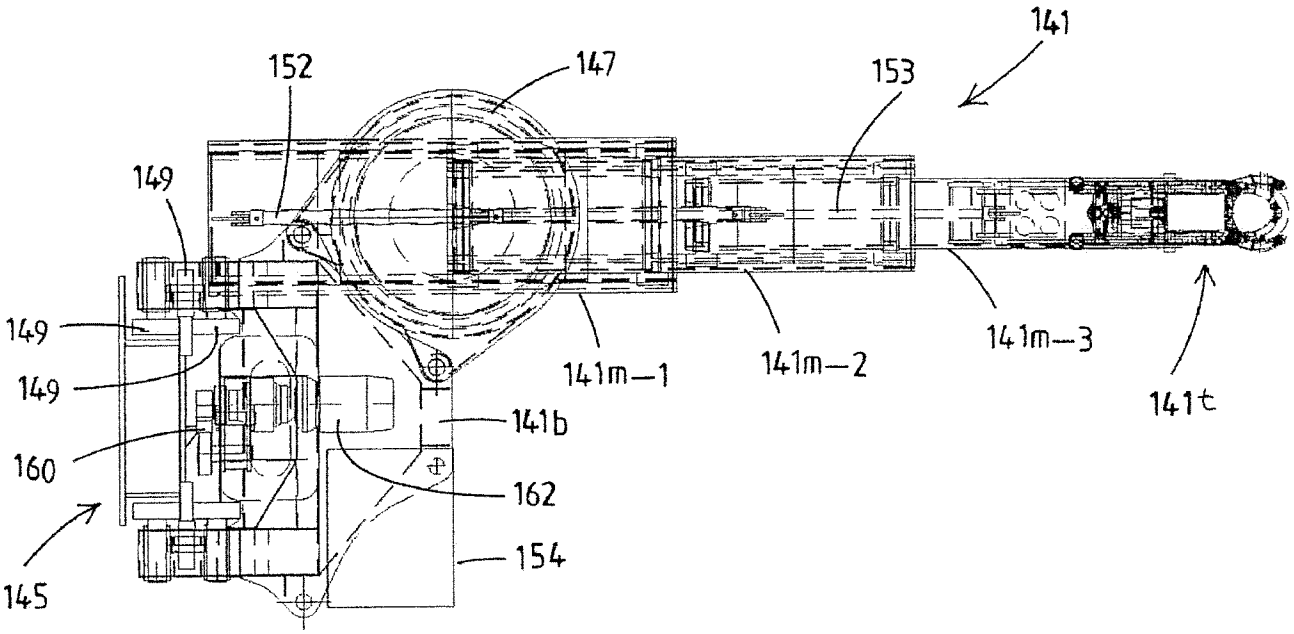
Figure 10:
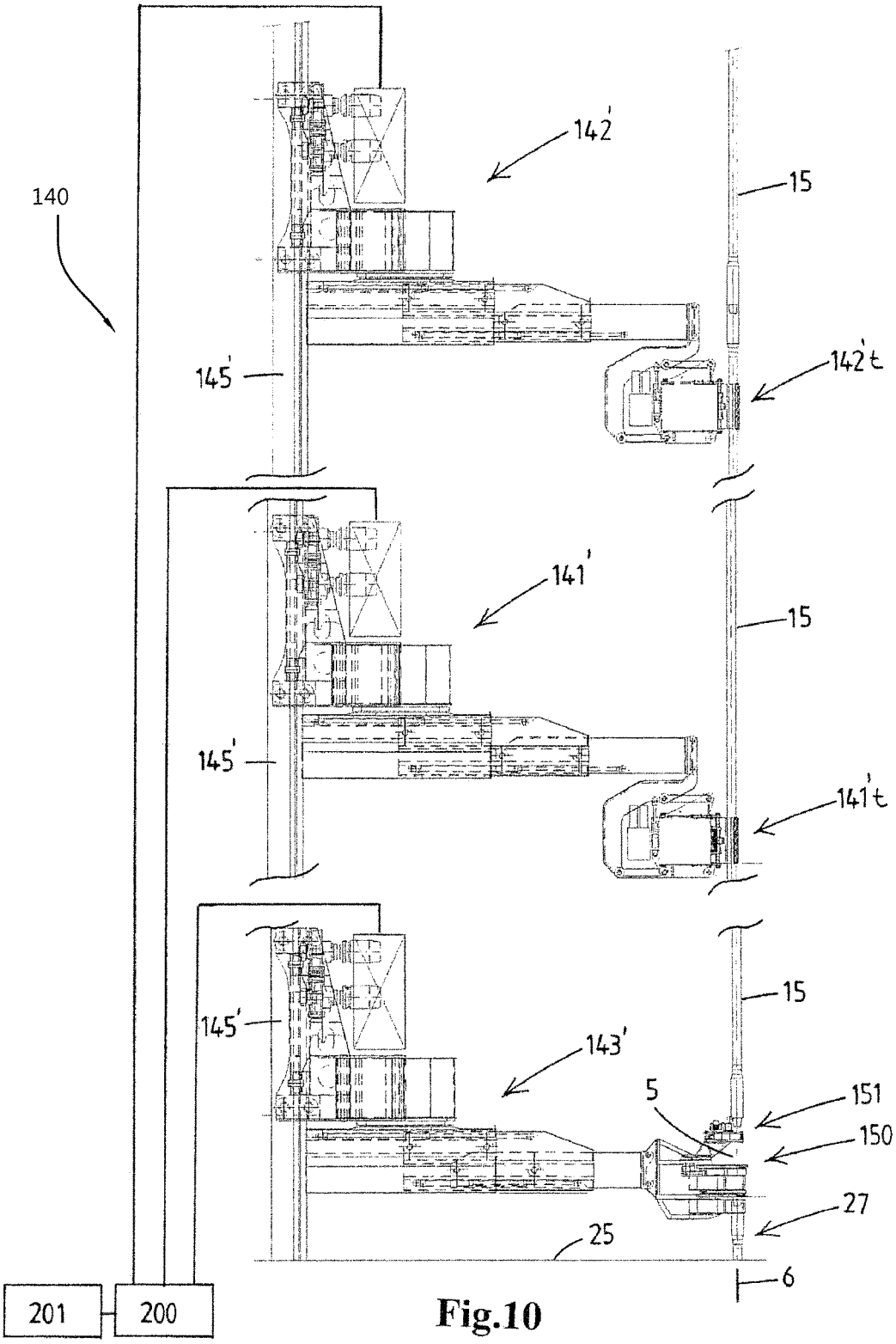
Figure 11:
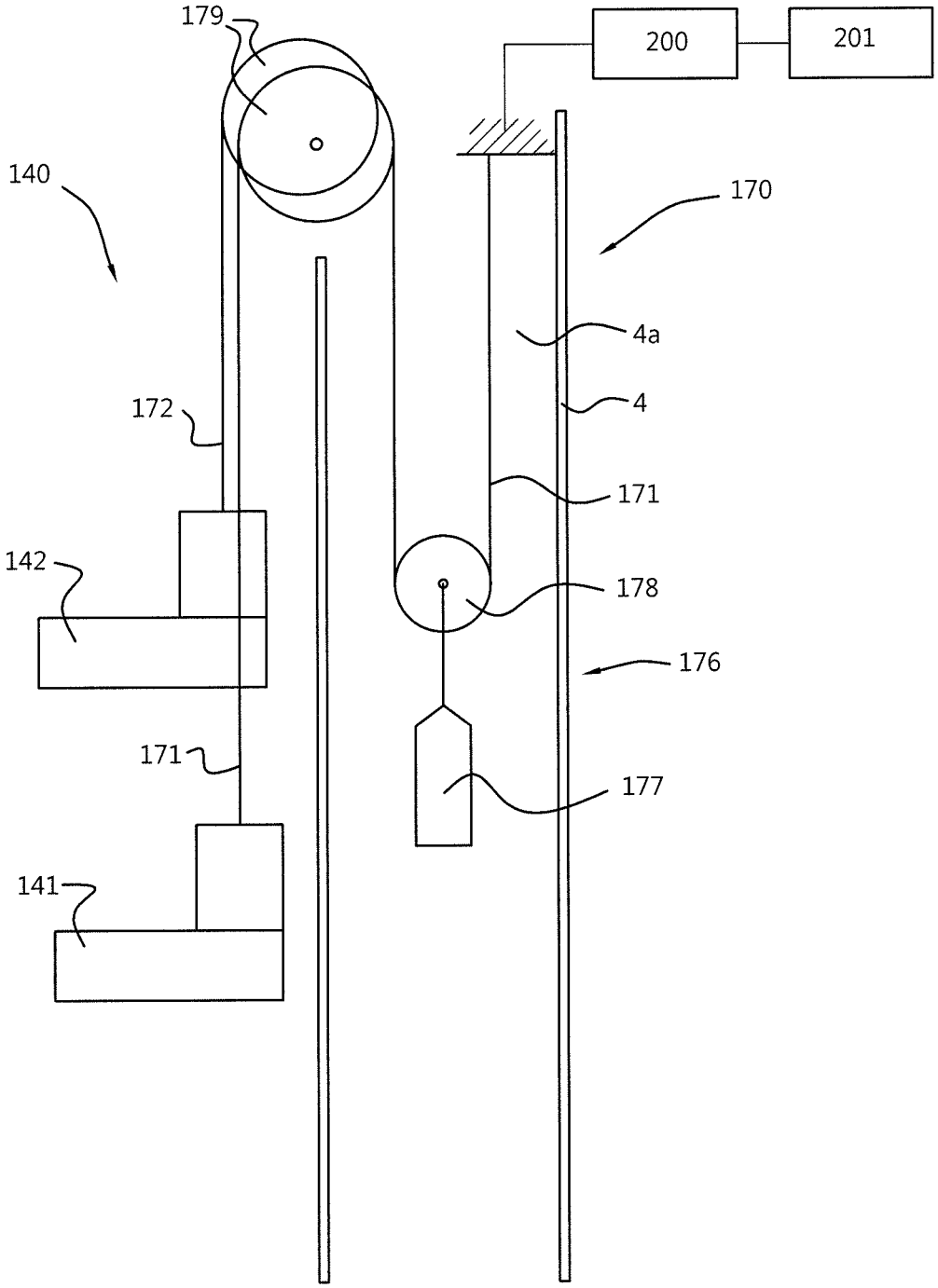

FIG. 9B shows the racker assembly of FIG. 9A in a side view, partly as wire frame, FIG. 9C shows the racker assembly of FIG. 9A in a top view, FIG. 10 illustrates the handling of a tubular by means of the racker assemblies with the lower assembly supporting an iron roughneck device; and FIG. 11 shows in a schematic view a suspension of a group of electrical cables extending in parallel around umbilical pulley towards several motion arm assemblies.

Figure 1:
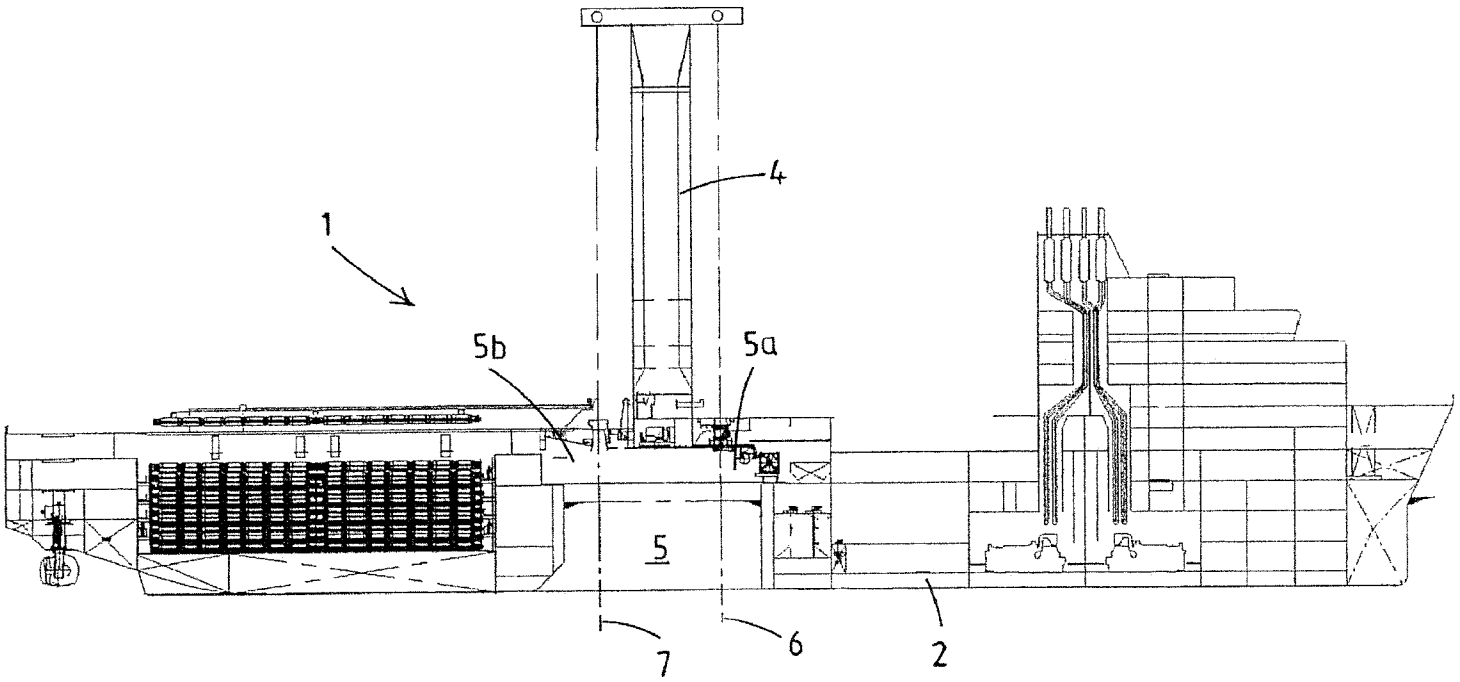

As shown in FIG. 1, the vessel 1 here is a monohull vessel having a hull 2 subjected to heave motion. The hull has a moonpool 5 extending through the hull, here with a waterline within the moonpool. In an embodiment as semi-submersible vessel the moonpool may be arranged in an above waterline deck box structure that is supported by columns on one or more pontoons, e.g. a circular pontoon in case an arctic design of the vessel is envisaged.

A drilling tower, here mast 4 is mounted on the hull, here above the moonpool 5. The mast 4 is associated with hoisting means, in the art called drawworks, in the shown embodiment forming two firing lines 6, 7 along and on the outside of the mast, here fore and aft of the mast 4, that extend through the respective fore and aft portions 5*a*, 5*b* of the moonpool 5.

The firing line 6 is designed for performing drilling, and here includes a drill string rotary drive, here a top drive 17 or other rotary drive, adapted for rotary driving a drill string.

Figure 2:
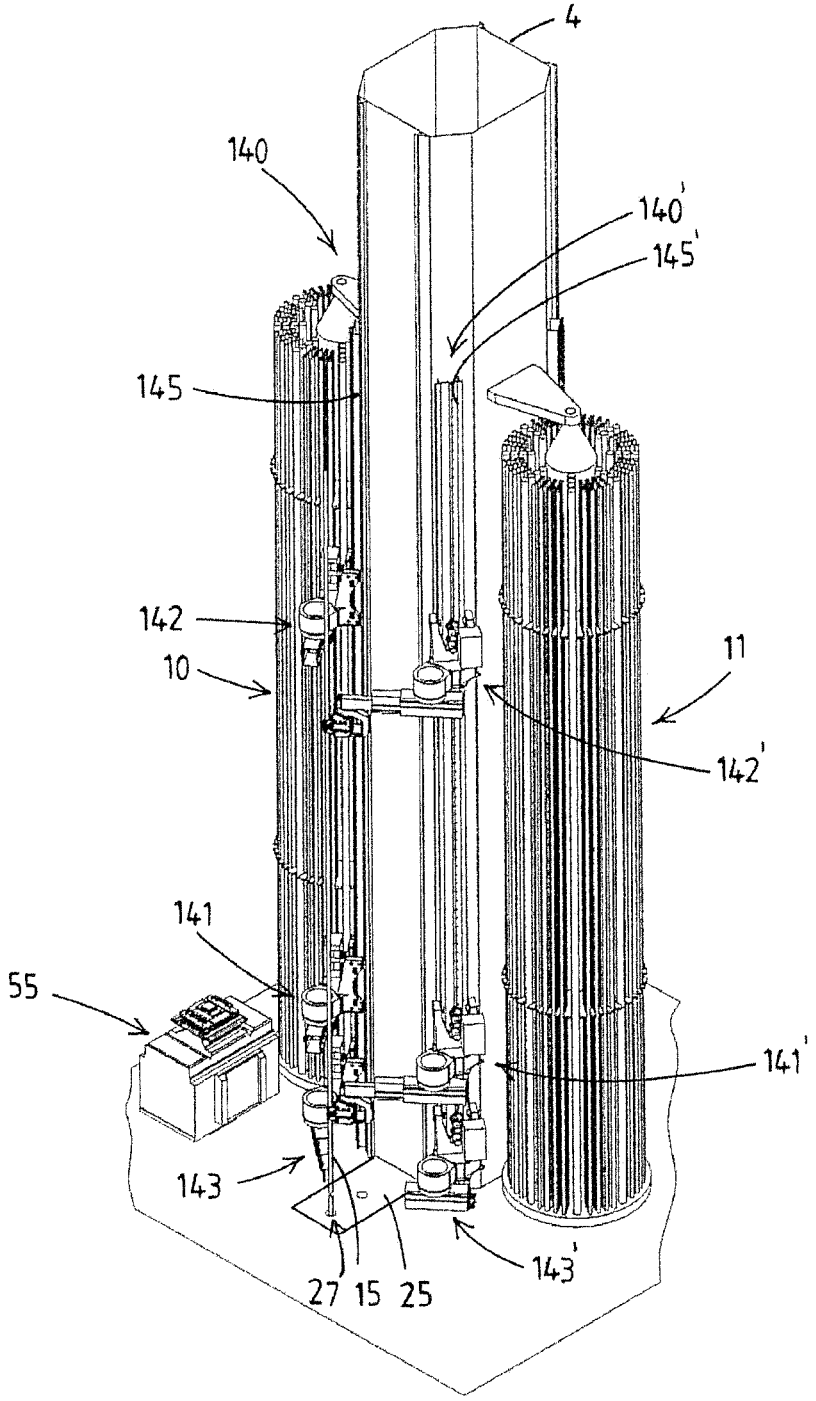
Figure 3:
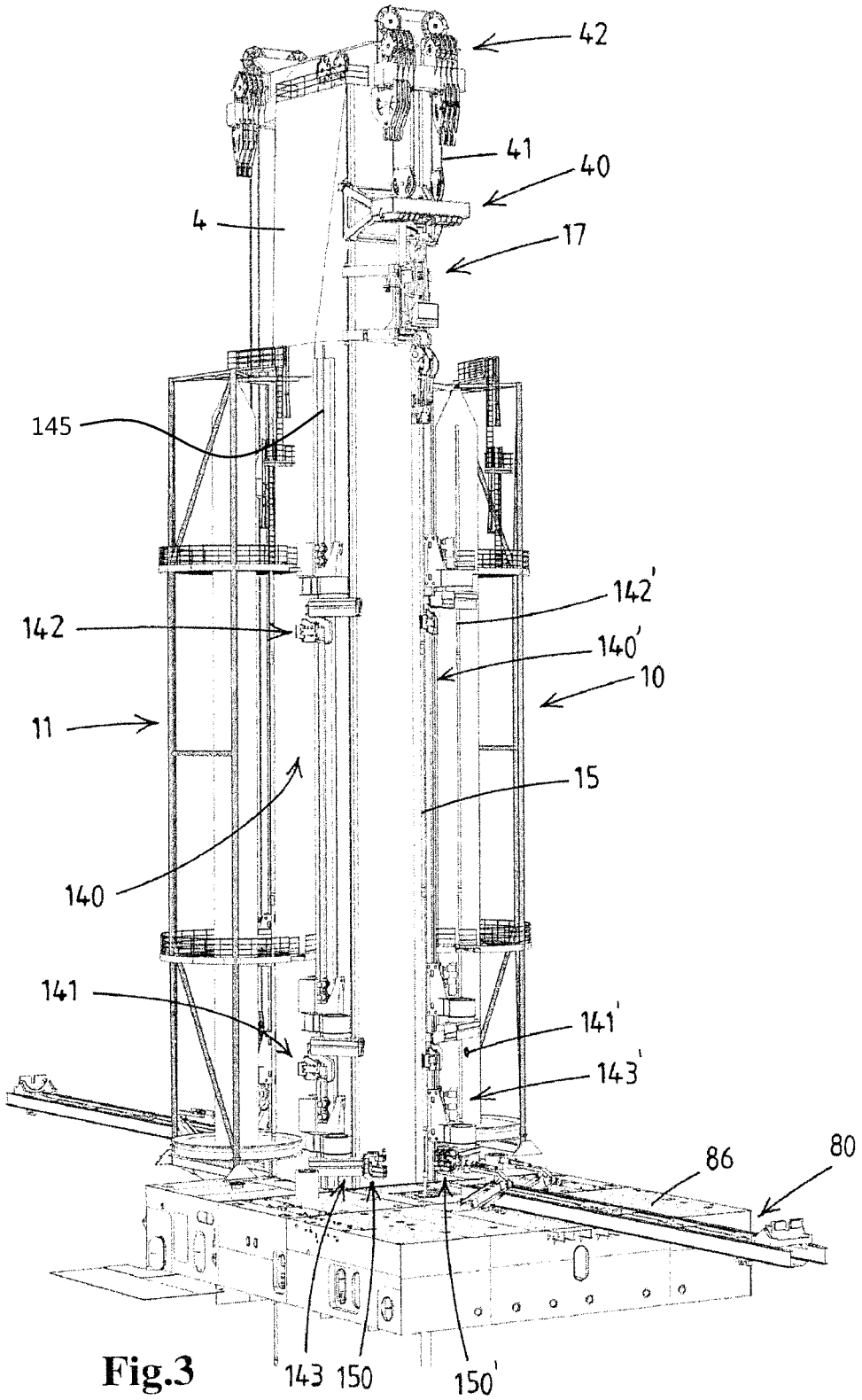
Figure 4:
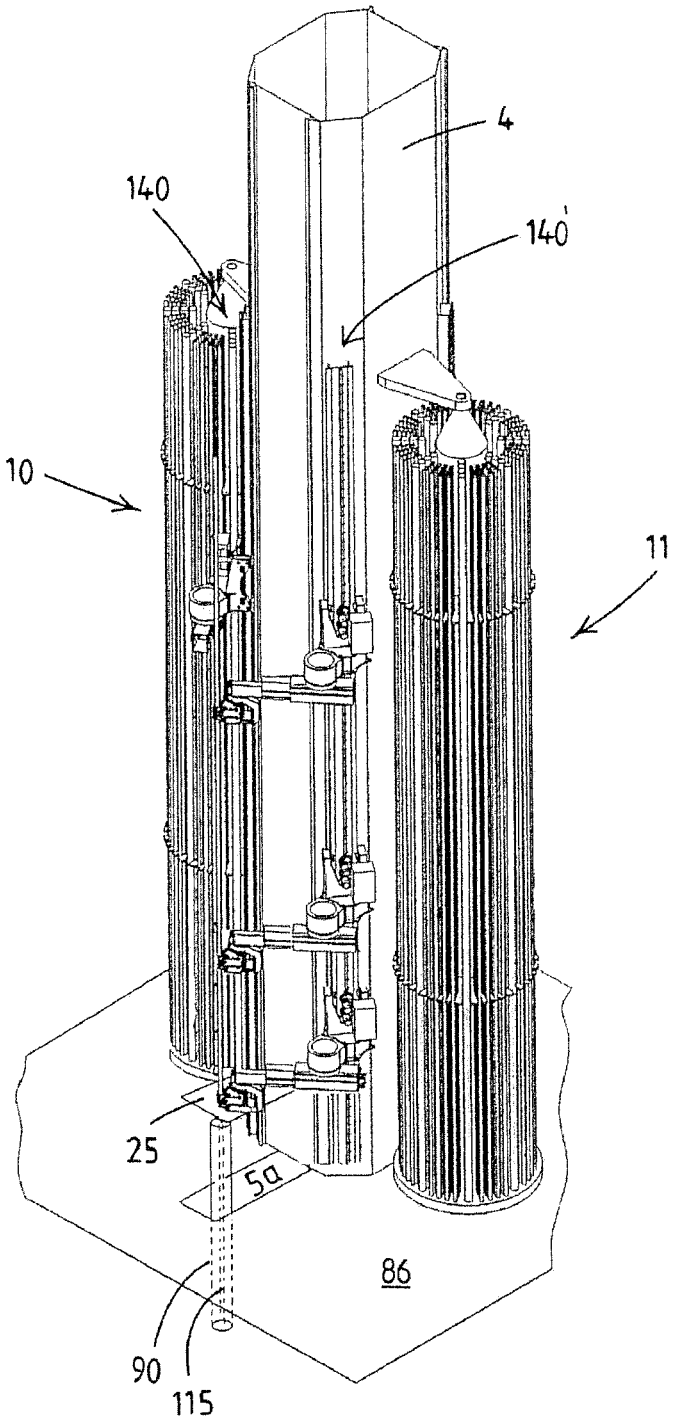

As shown in further detail in FIGS. 2 and 3, a movable working deck 25 is provided, having a well center or opening 27 therein through which a drill string passes, along the firing line, here firing line 6.

The vessel 1 is equipped with two drilling tubulars rotary storage racks 10, 11 adapted to store multiple drilling tubulars 15 in vertical orientation, preferably multi-jointed tubular stands.

Preferably, each drilling tubulars rotary storage rack is rotatable mounted on the vessel so as to rotate about a vertical axis.

As is known in the art each drilling tubulars rotary storage rack 10, 11 includes slots for the storage of multiple tubulars in each drilling tubulars rotary storage rack in vertical orientation. As is known in the art the racks 10, 11 here include a central vertical post and multiple disc members at different heights of the post, at least one disc being a fingerboard disc having tubulars storage slots, each slot having an opening at an outer circumference of the fingerboard disc allowing to introduce and remove a tubular from the storage slot. It is envisaged that in a preferred embodiment the tubulars rest with their lower end on a lowermost disc member. In the example shown it is envisaged that triple stands are stored in the racks 10, 11. The diameter of each rack 10, 11 is about 8 meters.

Drive motors are present for each of the first and second drilling tubulars rotary storage rack 10, 11 that allow to rotate the drilling tubulars storage rack about its vertical axis.

As shown in FIG. 3, the vessel 1 also includes a horizontal catwalk machine 80 on the deck and aligned with the relevant firing line and allowing to bring tubulars from a remote position towards the firing line or to a stand-building location, e.g. from hold for horizontal storage of drilling tubulars in the aft portion of the hull and/or the deck storage.

The vessel 1 also includes a driller's cabin 85 on a drillers cabin deck 86.

At the side of the mast 4 facing the vertically mobile working deck 25 two tubular racking devices 140 and 140' are mounted, each at a corner of the mast 4. If no mast is present, e.g. with a latticed derrick, a support structure can be provided to arrive at a similar arrangement of the racking devices 140 and 140' relative to the deck 25 and well center 27.

As is preferred each racking device 140, 140' has multiple, here three motion arm assemblies. Here a lower first racker motion arm assembly 141, 141', a second racker motion assembly 142, 142', operable at a greater height than the first tubular racker assembly, and a third well center tool motion arm assembly 143, 143'.

Each set of motion arm assemblies is arranged on a common vertical rails 145, 145' that is fixed to the mast 4, here each at a corner thereof.

Figure 6:
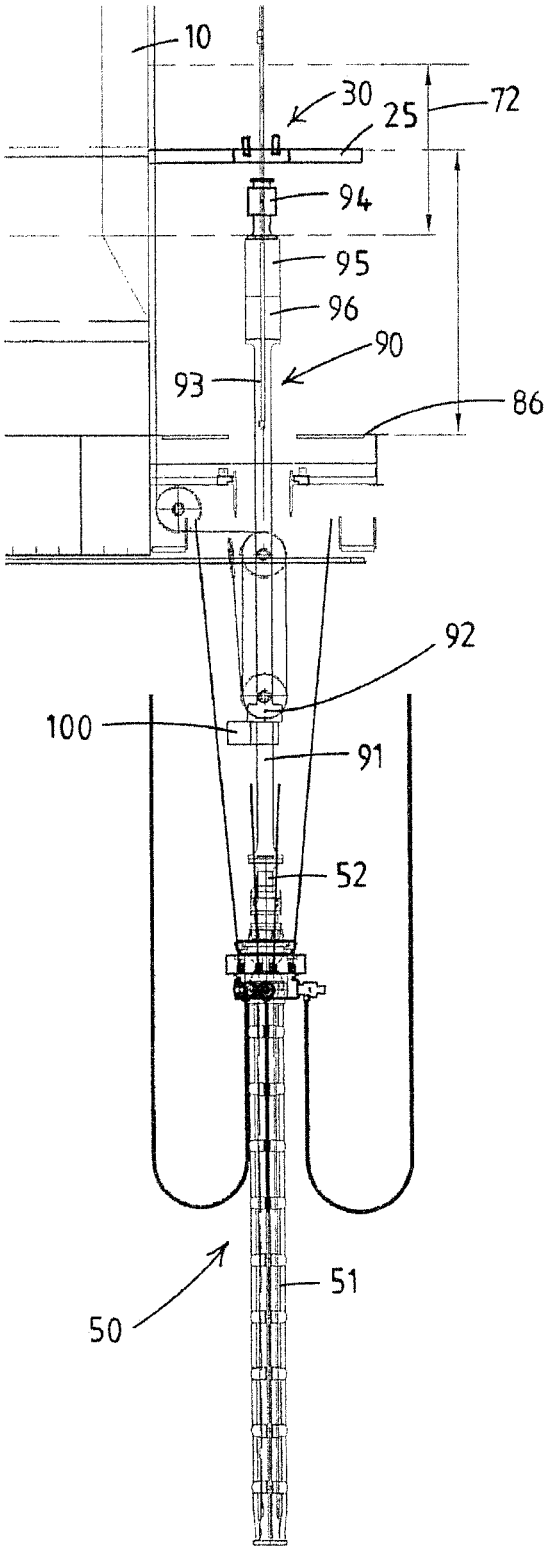

In FIG. 6, as can be better seen in the depiction of FIG. 10, a drill pipe multi-joint tubular 15 is held by racker assemblies 142' and 141' in the firing line above the well center 27, thereby allowing to connect the tubular 15 to the drill string supported, e.g., by drill string slip device 30 in or on the deck 25. Each of said assemblies 142' and 141' carries a tubular gripper member 142'*t* and 141'*t* at the end of the motion arm of the assembly. Instead of both assemblies carrying a gripper member it is also possible that only one arm is provided with a gripper member that supports the weight of the gripped tubular and the other arm carries a centralizer that holds the tubular in the upright position.

Figure 5:
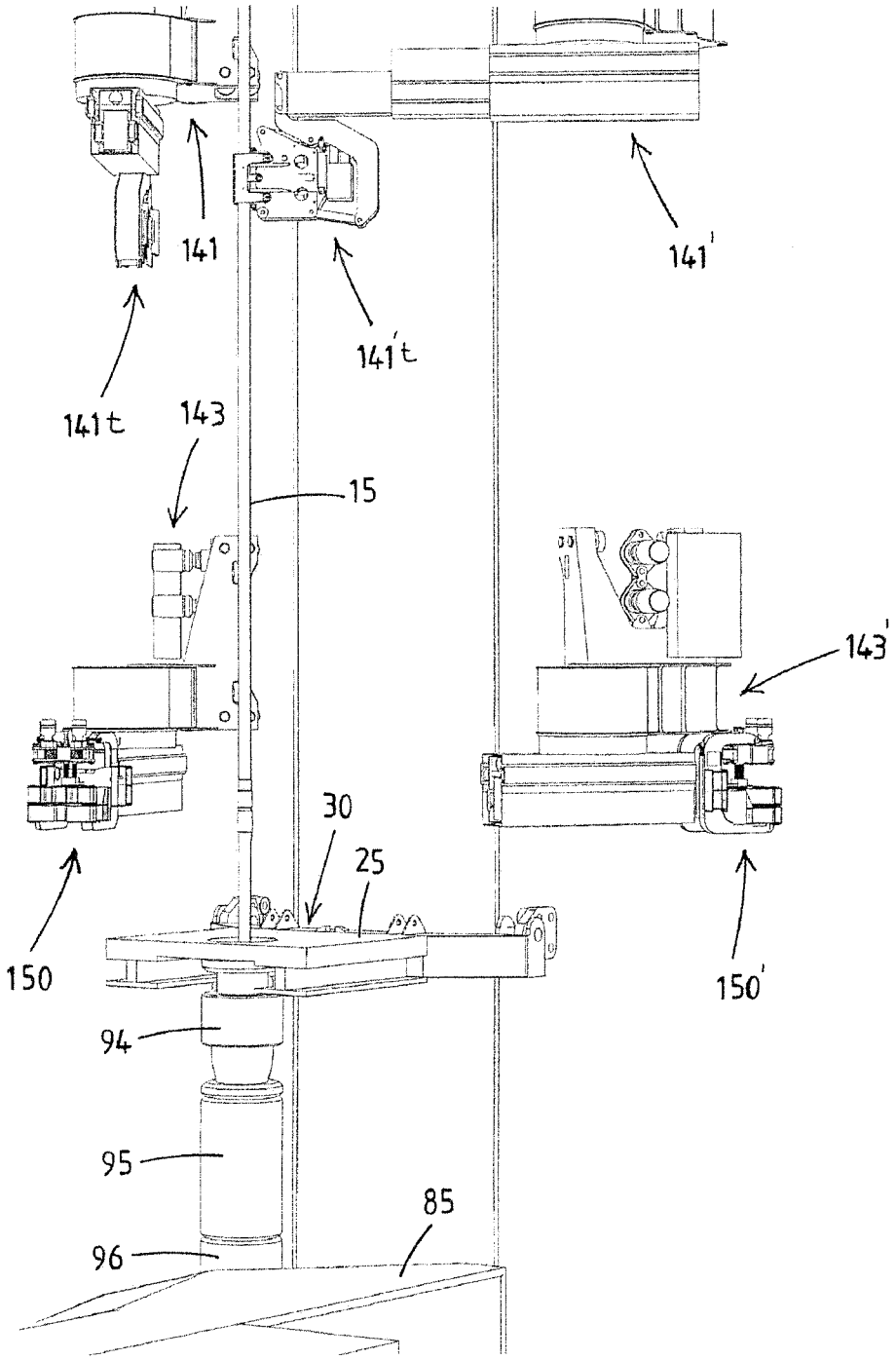

As shown in FIG. 5, the lower motion arm assembly 143 of the racking device 140 carries an iron roughneck device 150, here with a spinner 151 thereon as well.

Figure 7A:
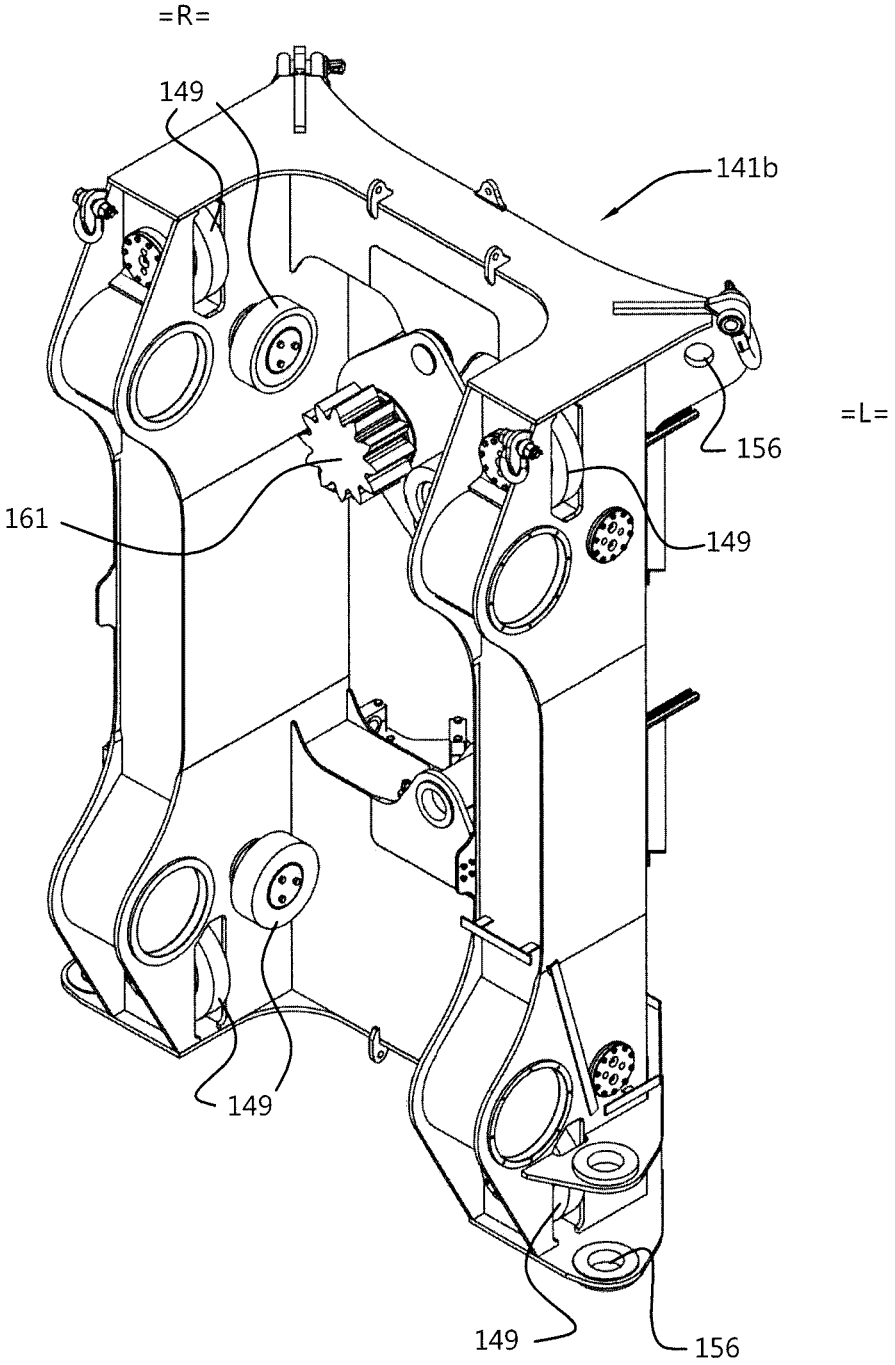
FIG. 7B shows in a top view the base of FIG. 7A together with a vertical rails.
FIG. 7C shows in a perspective view a motion arm of the motion arm assembly.
FIG. 7D shows in a top view an assembly of the base, rails and motion arm out of FIG. 7A-7C.
Figure 7B:
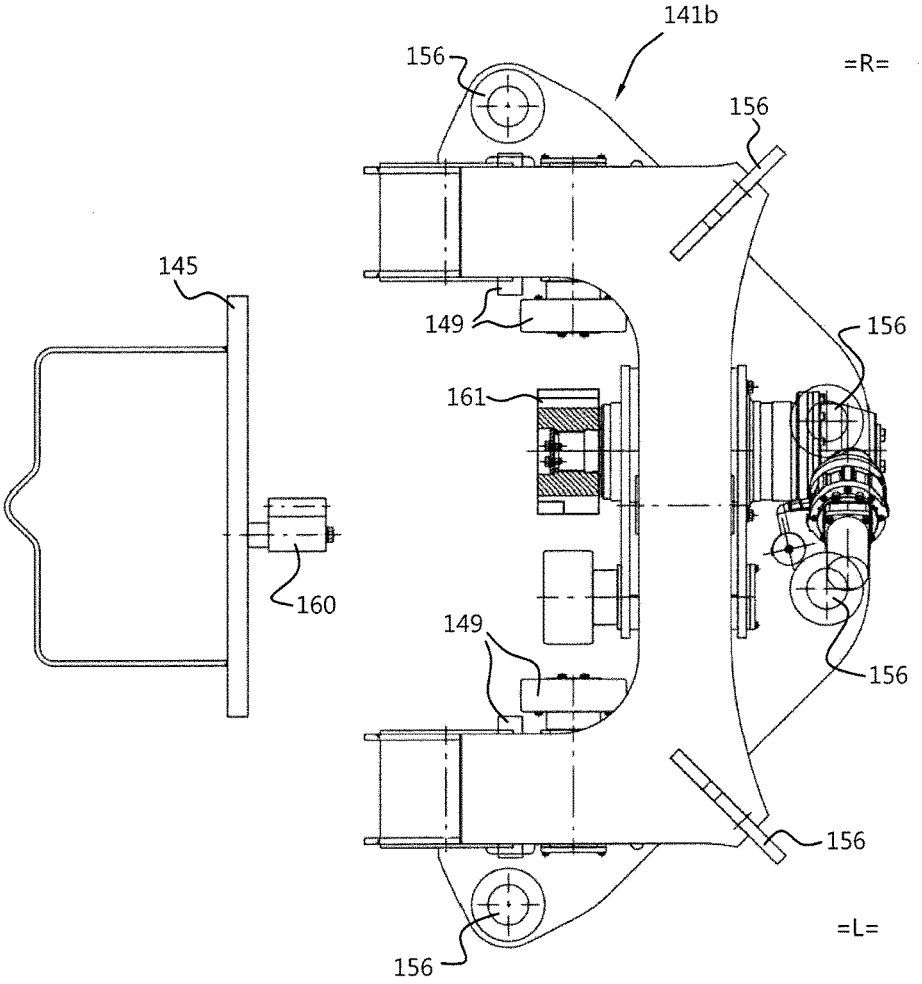
Figure 7C:
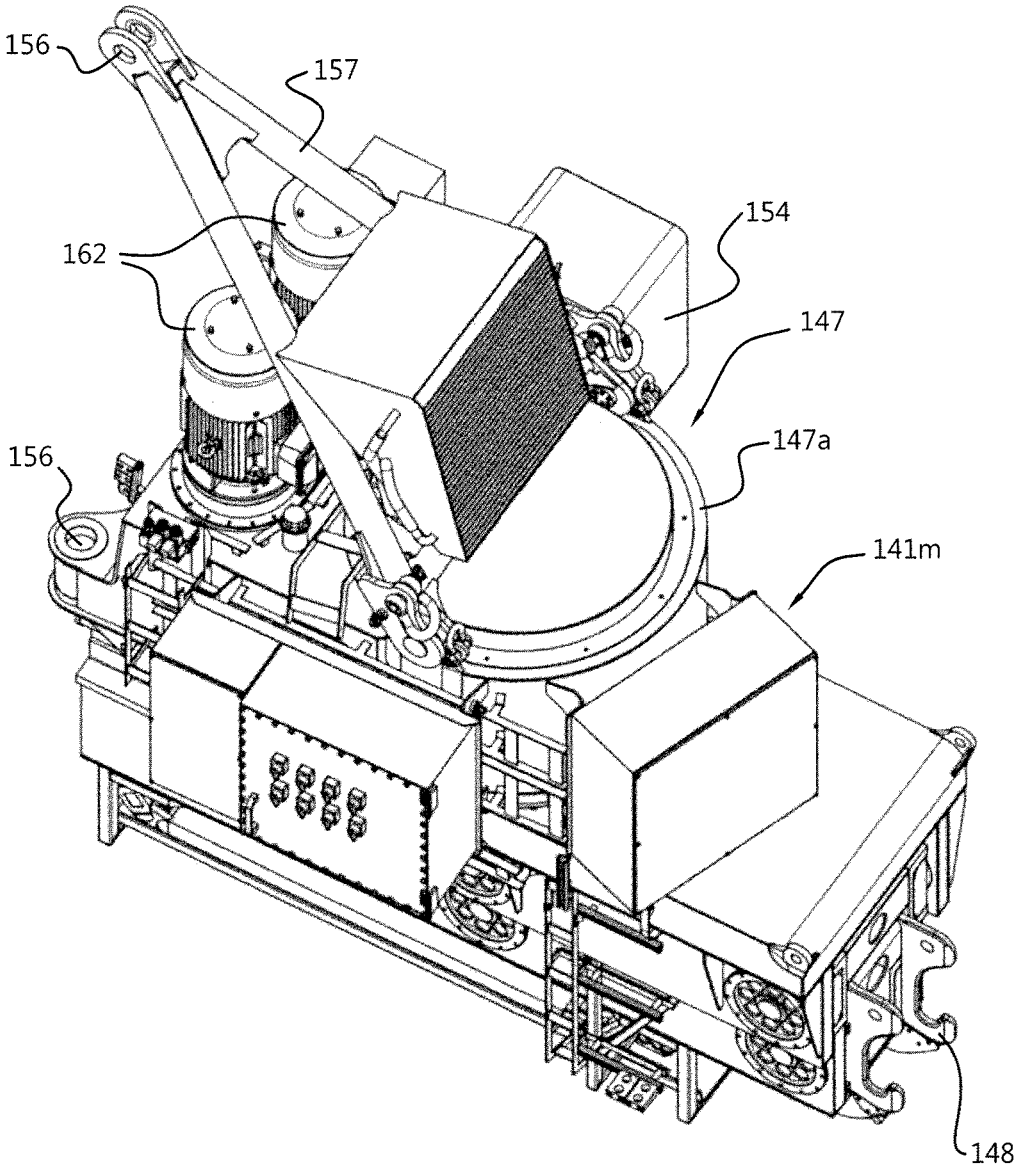

FIG. 7A-7D show the motion arm assembly 141 in further detail. FIG. 7A shows a base 141*b* of the motion arm assembly. The base 141*b* forms a sub-assembly which can be assembled together with a motion arm as shown in FIG. 7C. The base 141*b* is configured to allow different configurations of the motion arm assembly, in particular a left and right configuration.

Figure 7D:
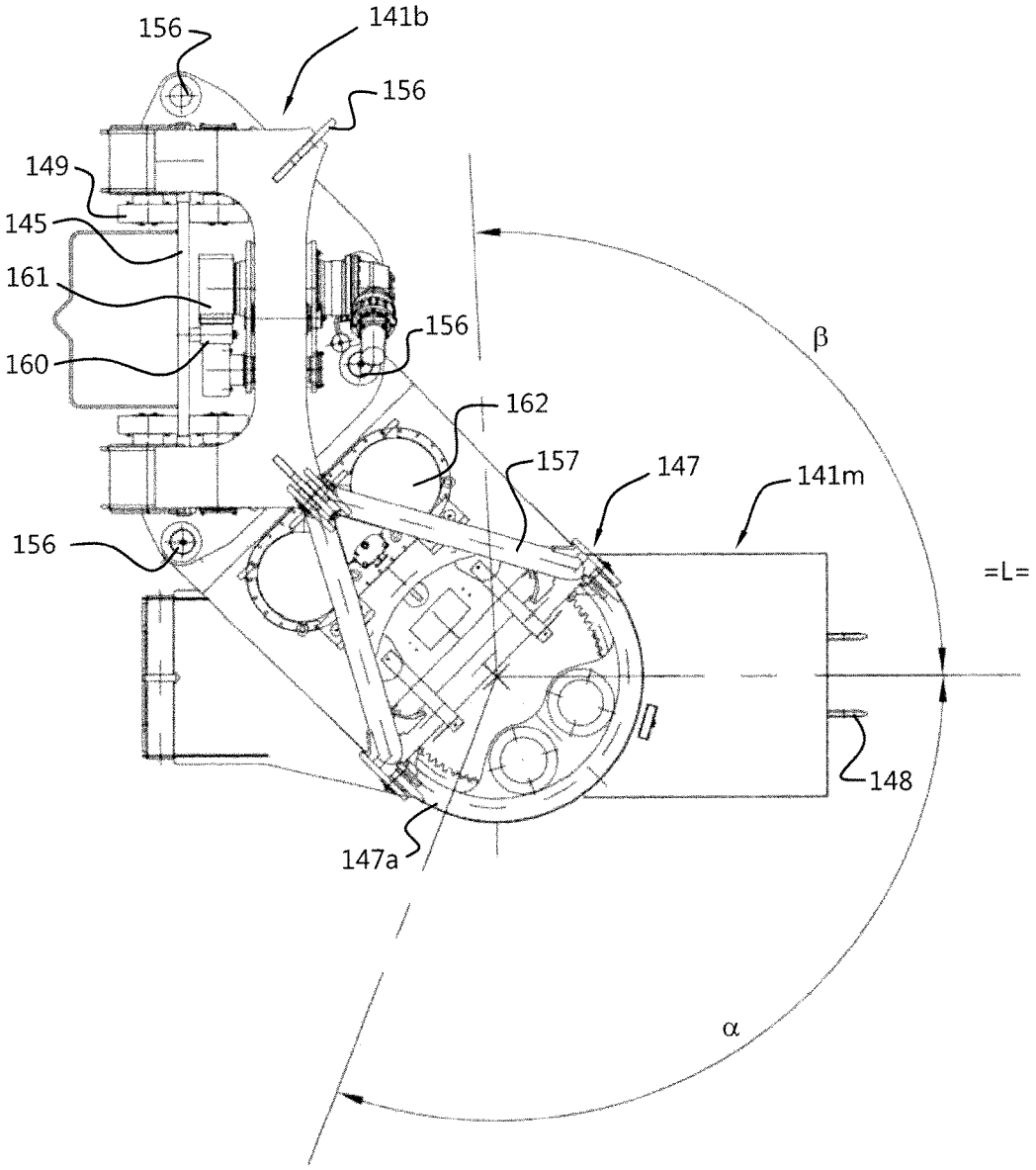

As shown in FIGS. 7A and 7B, the base 141*b* comprises a flange at a bottom region which is provided with two pairs of mounting holes and connector pins 156. At a top region, the base 141*b* further comprises mounting holes and pins which correspond with the respective first and second pair of mounting holes at the bottom region. Each pair of mounting holes of the base 141*b* corresponds with a pair of mounting holes of the arm assembly as shown in FIG. 7D and FIG. 8.

Figure 8:
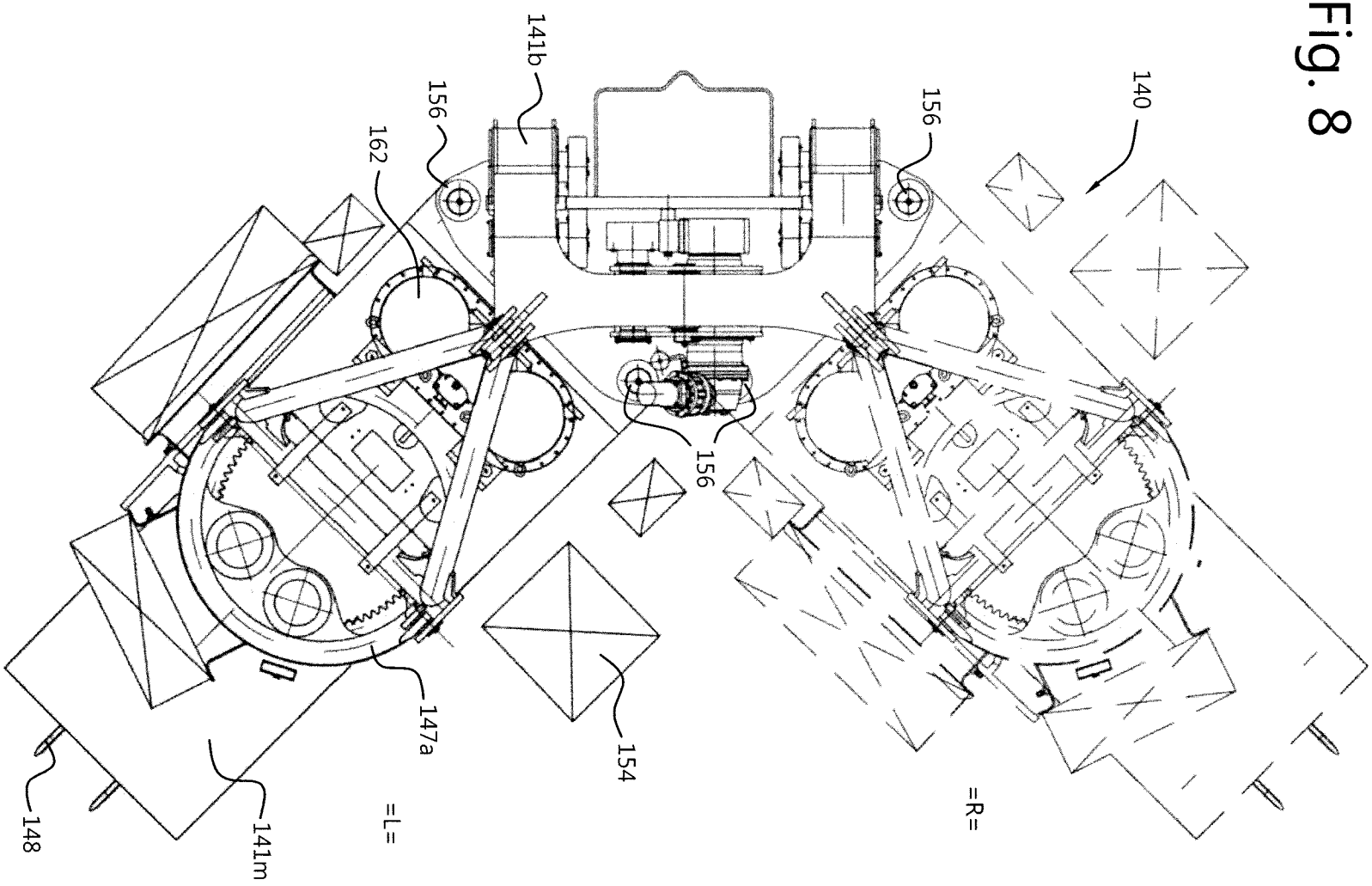
FIG. 8 shows in a top view a mounting of a left-hand and right-hand version of the motion arm to the base.

As shown in FIG. 8, the first pair of mounting holes is provided to obtain a left-hand attachment "L" of the motion arm, the second pair of mounting holes is provided to obtain a right-hand attachment "R" of the motion arm (illustrated by a dashed lines in FIG. 8).

A suspension beam 157 is provided to connect the motion arm to the top region of the base 141*b*. The suspension beam 157 comprises two legs. The two legs of the suspension beam 157 diverge in a direction away from the base 141*b*. A proximal end of each leg is connected to the base 141*b*, and a distal end is connected to the motion arm. The distal end of the suspension beam 157 is substantially positioned at a center of gravity of the motion arm. In particular, the distal end of the suspension beam 157 is connected at a position of the vertical axis bearing 147. Herewith, the suspension beam 157 contributes to an optimal dynamic behavior of the motion arm assembly in that a weight of the motion arm is substantially compensated in its center of gravity.

As can be seen in FIGS. 9A-9C the motion arm 141*m* is here embodied a telescopic extensible arm, the arm having a first arm segment 141*m*-1 which is connected to the base 141*b* via a vertical axis bearing 147 allowing the motion arm 141*m* to revolve about this vertical axis. As is preferred this vertical axis forms the only axis of revolution of the motion arm. The motion arm has two telescoping additional arm segments 141*m*-2 and 141*m*-3, with the outer arm segment being provided with a connector 148 for a tubular gripper 141'*t* and/or a well center tool (e.g. iron roughneck device 150).

The telescopic arm is rotatable from a neutral position, as illustrated in FIG. 7D, in a clockwise direction across angle $\alpha$ and in a counterclockwise direction across angle $\beta$. In the neutral position, the telescopic arm—seen in a top view—extends in a direction in parallel with a roll axis of the vessel. The telescopic arm is rotatable across the angle $\alpha$ to grip a tubular from a storage rack 10. The telescopic arm is rotatable across the angle $\beta$ to bring the gripped tubular to the firing line 6. The vertical axis bearing 147 is positioned with respect to the base 141*b*, such that the angle $\alpha$ extends from the neutral position to at least 70°, in particular at least 90°, more in particular at least 100° and the angle $\beta$ extends from the neutral position to at least −70° in particular about 90°. Herewith, the telescopic arm may have a compact configuration with an optimal reach.

In FIG. 2 reference numeral 55 depicts a well center tools storage structure that is adapted to store therein the one or more well center tools, e.g. an iron roughneck device 150, 150' that are connectable to the motion arm of the lowermost motion arm assembly 143, 143', As preferred one such storage is present at each side of the moonpool.

As visible in FIG. 9B, in the example shown a hydraulic cylinder 152 is present between first and second segments of the arm, and a further cylinder 153 between the second and third segments of the arm. Each cylinder 152, 153 is operable to cause extension and retraction of the arm. For example the racker assembly is provided with a self-contained hydraulic unit 154 including an electric motor driven pump, a tank, and valves.

In FIGS. 2-4 and 10 it can be recognized that each tubular racking device comprises a vertical guide rail 145, 145' onto which corresponding guide members of the base 141*b* of each tubular racker assembly engage. As shown in FIG. 9C, in this example the base 141*b* carries four sets of each three rollers 149 of which two rollers 149 ride along opposed faces of a flange of the rails 145 and one roller rides along a lateral side of the flange.

As shown in FIGS. 7B and 9, the racking device 140 further comprises a vertical toothed rack 160 arranged parallel to this vertical guide rails 145. Here the toothed rack 160 is mounted on the rail 145, here on a front plate of the rail between the two flanges of the rail 145.

The base 141*b* of the tubular racker assembly 141 is provided with one or more, here two, pinions 161 engaging with this vertical toothed rack 160. The base is provided with one or more motors 162, here two, driving the pinions, so as to allow for a controlled vertical motion of the racker assembly 141.

As is preferred the one or more motors 162 driving the one or more pinions 161 are electric motors. In an embodiment a supercapacitor 201 is included in an electric power circuit feeding said one or more vertical motion motors, which allows the temporary storage of electricity that may be generated by said one or more motors during a downward motion of the assembly. This energy can then be used for the upward motion again.

In view of a reduction of the number of parts it is preferred for all motion arms to be identical, so that limited spare parts are needed. For example a single complete motion arm, or a single complete racker assembly is stored aboard the vessel.

As shown in FIG. 9B, in view of reduction of the number of parts it is preferred for the vertical axis bearing 147 between the base 141*b* and the motion arm 141*m* to be arranged in a bearing housing 147*a* that is releasable attached to the base 141*b* of the racker assembly. As depicted in FIG. 8 here the base 141*b* provides both a left-hand attachment position "L", as indicated in FIG. 7D, and a right-hand attachment position "R", as shown in use in FIG. 9A, for the bearing housing 147*a* which allows to use the same base in each of the racking devices 140 and 140'. As is preferred and shown in FIG. 8, the attachment positions are formed by elements on the base having holes therein and the housing 147*a* having mating holes therein, so that one or more connector pins 156 can be used to secure the housing to the base.

As shown in FIG. 10 the motion arm assembly 143 holds iron roughneck device 150 above the well center for make-up or breaking up of connections between tubulars in the firing line 5. At the same time the other motion arm assembly 143' can be equipped with a second iron roughneck device, which is then already prepared for handling different diameter tubulars.

Should e.g. assembly 141' fail to operate, its task can be taken over by assembly 143' on the same rails 145' as it may be quickly equipped with a tubulars gripper and brought to the level appropriate for tubulars racking. For example the assembly 141' is then raised to make room for the assembly 143'.

The vessel comprises an electrical heave motion compensation controller 200, e.g. a computerized controller linked to a system detecting heave motion. This controller 200 is linked to the vertical drive of the bases of the vertically mobile motion arm assemblies.

The heave motion controller 200 provides to these one or more vertical drives, e.g. to the pinion driving motors, a control signal representing a heave compensation motion of the one or more motion arm assemblies. This allows to obtain heave motion compensation of the tubular gripper or well center tool held by the respective motion arm.

This embodiment is, for example, of use in combination with a heave motion compensated working deck, e.g. as disclosed in WO2013/169099. For example a motion arm assembly can then be employed to hold a component of a coiled tubing injector device in a position above the well center whilst the drill floor is in heave compensation mode. Of course other heave motion compensation arrangements of the drill floor can also be envisaged in combination with the present invention.

The depicted embodiment all motion arm assemblies are connected to the electrical heave motion compensation controller 200, allowing all operations thereof to be done whilst performing heave compensation motion, e.g. in conjunction with a heave motion performing working deck 25.

FIG. 11 shows in a schematic view an electric power supply 170. The electric power supply 170 is connected to the controller 200 which in a first aspect of the invention can be part of the heave motion synchronization system or according to a second aspect of the invention of another motion system. The electric power supply 170 comprises at least one umbilical cable 171, 172 which extends from the controller 200 to the motion arm assemblies 141, 142. As shown in FIG. 11, a plurality of umbilical cables 171, 172 may be arranged in parallel to electrically connect a plurality of motion arm assemblies 141, 142.

The umbilical cable 171 is an electrical cable for feeding electrical components, in particular the electric motor 162, on board of the motion arm assembly. The umbilical cable 171 extends along the mast 4. During a movement of a motion arm assembly, a length of the umbilical cable 171 along the mast 4 varies. Preferably, the electric power supply 170 comprises a cable length compensating device 176 for compensating the varying length along the mast 4. Preferably, the cable length compensating device 176 is positioned inside an inner space 4*a* of the mast 4.

Here, the umbilical cable 171 extends upwards from the motion arm assembly to a top region of the mast 4. At the top region of the mast 4, the umbilical cable 171 is looped around a pulley 179 which is fixed in position with respect of the mast 4. The mast 4 is a hollow mast which includes a mast inner space 4*a*. The umbilical cable 171 extends from the fixed pulley 179 in a downwards direction into the mast inner space 4*a*. The umbilical cable 171 extends inside the mast inner space and is looped around at least one movable pulley 178 of the cable length compensating device 176. The pulley 178 is movable with respect to the mast 4. The movable pulley 178 serves to compensate a varying length of the umbilical cable 171 during a movement of the motion arm assembly. The movable pulley 178 comprises a counterweight 177 to maintain a certain tensile force on the umbilical cable 171 during movement of the motion arm assembly. Preferably, the movable pulley 178 and the counterweight 177 is arranged to move along a pulley distance at a bottom region of the mast 4 to contribute to a low positioned center of gravity.

In an alternative embodiment, instead of the movable pulley 178 including the counterweight 177 as a cable length compensating device 176, a winch may be provided to compensate for the varying length of the umbilical cable 171 during operation.

In particular when heave motion compensation mode of one or more of the mobile motion arm assemblies is envisaged, the electric power supply 170 may include a supercapacitor 201, even such a capacitor mounted on the base of each assembly itself, for temporary storage of electric energy in the downward motion and use thereof for the upward motion. Preferably, a single capacitor is used for the racking device 140, wherein the capacitor is positioned at a position which is fixed with respect to the hull 2 of the vessel 1. Preferably, the capacitor 201 is placed at the deck of the vessel.

In an embodiment wherein the mobile base of each mobile motion arm assembly 141,142,143 engages with a pinion 161 on a vertical rack, one may provide heave motion compensation also by bringing said vertical toothed rack 160 into heave compensation motion, e.g. the toothed rack being slidable along the tower or mast 4 and with a vertical heave motion drive connected to the rail 145, 145' or with the rail being connected to another object that is brought into heave compensation mode. For example one could envisage that the toothed rack is connected to the working deck 25, with the working deck 25 being operable in heave compensation mode so that the toothed rack follows the working deck 25.

The vessel 1 does also include a main hoisting device comprising a main hoisting winch and main cable connected to said winch, and a travelling block 40 suspended from said main cable 41, e.g. with a multiple fall arrangement between a crown block 42 and the block 40. From the travelling block the tubular string 15*a* is suspended when the slip device 30 is released from the drill string. An intermediate topdrive 17 then provides the rotary drive for the drill string.

As is preferred a drill string heave compensation system is provided to effect heave compensation of the drill string, here of the travelling block 40, e.g. in the manner as described in U.S. Pat. No. 6,595,494, where a travelling block heave compensation system comprises two main cable heave compensation sheaves, each one in the path between a main hoisting winches and the travelling block. Each of these sheaves is mounted on the rod of a compensator cylinder, with these cylinder connected, possibly via an intermediate hydraulic/gas separator cylinder, to a gas buffer as is known in the art.

FIG. 6 shows the vertically mobile working deck 25 that is vertically mobile within a motion range including a lower stationary position 86, wherein the working deck is used as stationary drill floor deck with the slip joint 50 unlocked, and the motion range further including a heave compensation motion range 72 that lies higher than the lower stationary position 86. In this heave compensation motion range the working deck 25 can perform heave compensation motion relative to the hull of the vessel.

For example the heave compensation motion range is between 5 and 10 meters, e.g. 6 meters. For example the average height of the working deck in heave motion above the driller cabin deck 86 with cabin 85 of the vessel is about 10 meters.

The FIG. 6 further shows an upper riser section 90 that is mounted at the top of the riser and extends upward from the inner barrel 52 of the slip joint 50 at least to above the lower stationary position 86 of the working deck, preferably to the heave compensation motion range of the deck 25.

A lower section member 91 here forms the rigid connection between the actual end of the inner barrel 52 and a connection cable connector 100 of a heave compensation arrangement, here with said member 91 having a collar 92 that rests on the connector 100. From said member 91 upwards a further riser member 93 extends upward to above the level 86. Above said riser member 93 equipment to be integrated with the riser top, such as preferably at least a rotating control device (RCD) 94, and a mudline connector 95 are mounted. For example other riser integrated equipment like an annular BOP 96 may be arranged here as well.

With the slip joint 50 in collapsed and locked position, as here, the working deck 25 that rests on top of the riser section 90 performs a heave motion compensation motion relative to the vessel's hull as the riser is now a fixed length riser due to the locking of the slip joint 50.

The described motion arm assemblies allow drilling and tripping as they are able to synchronize their vertical motion with the heave motion so that, from the standpoint of the working deck, drilling and tripping can be carried out in a proper way.

Thus, the invention provides an offshore drilling vessel comprising a floating hull subjected to heave motion. The hull comprises a moonpool and a drilling tower near the moonpool. A drilling tubulars storage rack is provided for storage of drilling tubulars. The vessel comprises a heave motion compensation support that is adapted to support a slip device whilst performing heave compensation motion relative to the heaving motion of the vessel. A racking device is provided with a heave motion synchronization system that is adapted to bring a tubular retrieved from the storage rack which is in a in heave motion into a vertical motion that is synchronous with the heave compensation motion of the string slip device. The racking device comprises a vertical rails and at least two separate motion arm assemblies mounted on said vertical rails. Each separate motion arm assembly comprises its own vertical drive which is electrically connected to the heave motion synchronization system.

Reference list:

| | |
|---|---|
| 1 | vessel |
| 4 | mast |
| 5 | moonpool |
| 5a, 5b | fore and aft on the outside of the mast |
| 6, 7 | firing line |
| 10 | rotary storage rack |
| 11 | rotary storage rack |
| 17 | topdrive |
| 25 | mobile working deck |
| 27 | well center |
| 30 | slip device |
| 40 | travelling block |
| 41 | main cable |
| 42 | crown block |
| 50 | slip joint |
| 52 | inner barrel |
| 72 | heave compensation motion range |
| 80 | catwalk machine |
| 85 | driller's cabin |
| 86 | lower stationary position |
| 90 | upper riser section |
| 91 | lower section member |
| 92 | collar |
| 93 | riser member |
| 94 | rotating control device |
| 95 | mudline connector |
| 96 | BOP |
| 100 | cable connector |
| 140 | racking device |
| 141, 142 | motion arm assembly |
| 141b, 142b | base |
| 141t, 142t | tubular gripper |
| 141m, 142m | arm segment |
| 143 | well center tool motion arm assembly |
| 145 | vertical rails |
| 147 | vertical axis bearing |
| 147a | bearing housing |
| L | left-hand attachment position |
| R | right-hand attachment position |
| 148 | connector for gripper or well center tool |
| 149 | roller |
| 150 | iron roughneck device |
| 152, 153 | hydraulic cylinder |
| 154 | hydraulic unit |
| 156 | connector pin |
| 157 | suspension beam |
| 160 | toothed rack |
| 161 | pinion |
| 162 | motor |
| 170 | electric power supply |
| 171, 172 | umbilical cable |
| 179 | fixed pulley |
| 178 | movable pulley |

-continued

| Reference list: | |
|---|---|
| 177 | counterweight |
| 200 | controller |
| 201 | super capacitor |

The invention claimed is:

1. An offshore drilling vessel, the vessel comprising:

a floating hull subjected to heave motion, the hull being provided with a moonpool;

a drilling tower at or near the moonpool, wherein the drilling tower includes an inner space;

a drilling tubulars storage rack adapted for storage of drilling tubulars in vertical orientation therein, the storage rack being mounted on the hull so as to be subjected to heave motion along with the hull;

a tubulars string slip device, configured to support a weight of a tubulars string suspended therefrom along a firing line;

a heave motion compensation support configured to support said tubulars string slip device whilst performing a heave compensation motion relative to a heaving hull of the vessel;

a racking device configured to move a tubular between the storage rack and a position in the firing line above the tubulars string slip device in order to allow for making a connection between a new tubular and the suspended tubulars string or the removal of a tubular from the tubulars string during tripping, the racking device comprising:

a motion system, including a controller, the motion system being configured to bring a tubular retrieved from the storage rack into a vertical motion that is synchronous with the heave compensation motion of the tubulars string slip device, thereby allowing for the connection of the tubular to the suspended tubulars string whilst the slip device performs the heave compensation motion relative to the heaving hull of the vessel; and at least one motion arm assembly, comprising:

a base that is vertically mobile on the drilling tower by a vertical drive; and a motion arm connected to said base, the motion arm being provided with a tubular gripper member connected to said motion arm, wherein the vertical drive is electrically connected to the controller of the motion system, wherein the at least one motion arm assembly comprises a hydraulic power unit including a pump, wherein said hydraulic power unit is connected to the controller by at least one umbilical cable, wherein one end of the umbilical cable is connected to the controller and the other end is connected to the hydraulic power unit on board of the motion arm assembly, wherein the umbilical cable is looped around a cable length compensating device including a movable umbilical pulley to compensate for a varying umbilical cable length in between the controller and the hydraulic power unit which varying umbilical cable length is during operation caused by a motion of the motion arm assembly, wherein the umbilical pulley is provided with a counterweight to maintain a tension in the umbilical cable during the motion of the at least one motion arm assembly, and wherein the cable length compensating device is positioned inside the inner space of the drilling tower.

2. The vessel according to claim 1, wherein the racking device comprises at least two motion arm assemblies, wherein each vertical drive of each of the at least two motion arm assemblies comprises a hydraulic power unit (HPU) including a pump driven by an electric motor, a tank, and valves.

3. The vessel according to claim 1, wherein said one end of the umbilical cable is connected to the controller at a fixed position on the floating hull.

4. The vessel according to claim 1, wherein the drilling tower comprises a mast, wherein a side of the mast facing the moon pool is provided with two racking devices each comprising at least two motion arm assemblies in a substantially mirrored symmetry.

5. The vessel according to claim 1, wherein the racking device comprises vertical rails comprising a vertical toothed rack, with the mobile base having one or more motor driven pinions engaging said toothed rack.

6. The vessel according to claim 5, wherein the vertical rails comprise vertical guide rails onto which corresponding guide members of the base of the motion arm assembly engage, and wherein the vertical toothed rack is arranged parallel to said vertical guide rails, wherein the base of the racking device is provided with one or more pinions engaging said vertical toothed rack, the base being provided with one or more motors driving said one or more pinions.

7. The vessel according to claim 5, wherein the toothed rack is vertically mobile so as to perform a heave compensating motion, when connected to a dedicated vertical drive of the toothed rack or when connected to another component that is or can be brought in heave compensation motion, to a heave compensated working deck or a travelling block of heave compensated drawworks.

8. The vessel according to claim 1, wherein the vessel comprises an iron roughneck device independently supported with respect to the floating hull by an iron roughneck support device, which is a mobile motion arm assembly including a base which is vertically movable.

9. The vessel according to claim 1, wherein the motion arm is a telescopic extensible arm, the arm having a first arm segment which is connected to the base via a vertical axis bearing allowing the motion arm to revolve about said vertical axis, said vertical axis forming the only axis of revolution of said arm, and wherein said arm comprising one or more telescoping additional arm segments.

10. The vessel according to claim 9, wherein the motion arm is connected to the base via a horizontal axis bearing allowing the motion arm to revolve about a horizontal axis to provide a pivoting in up and down motion, such that at least some of the motion required to obtain the synchronised heave motion can be derived from said pivoting.

11. The vessel according to claim 1, wherein the storage rack is a rotary storage rack which is rotatable mounted on the vessel.

12. The vessel according to claim 1, wherein the vessel comprises:

a drill string main hoisting device comprising:

a main hoisting winch and main cable connected to said winch; and a travelling block suspended from said main cable, wherein the travelling block is adapted to suspend a drill string therefrom along a drilling firing line, with an intermediate topdrive adapted to provide a rotary drive for the drill string; and a drill string heave compensation system adapted to provide heave compensation of the drill string.

13. The vessel according to claim 1, wherein the vessel is provided with a mobile working deck and with a dedicated working deck heave compensation system adapted to provided heave compensation motion of the working deck.

14. The vessel according to claim 1, wherein the counterweight is arranged to move along a pulley distance at a bottom region of the drilling tower to contribute to a low positioned center of gravity.

15. The vessel according to claim 14, wherein an electric motor of the hydraulic power unit is connected with a supercapacitor which allows a temporary storage of electricity.

16. The vessel according to claim 14, wherein an electric motor of the hydraulic power unit is positioned at a distance away from said gripping member, such that the motor is positioned outside an Ex-zone.

17. A method for drilling a subsea wellbore, wherein use is made of a drilling vessel according to claim 1, and wherein the method involves—with the slip device supporting a suspended tubulars string and being in heave compensation motion relative to the hull of the vessel:

retrieving a tubular from the storage rack with the racking device;

bringing the retrieved tubular in a vertical motion pattern relative to the hull of the vessel that is synchronized with the heave compensation motion of the slip device, as well as moving the tubular into the firing line above the slip device; and connecting the tubular to the tubulars string suspended from the slip device.

* * * * *